US010106984B2

(12) United States Patent
Munsell et al.

(10) Patent No.: US 10,106,984 B2
(45) Date of Patent: Oct. 23, 2018

(54) TOOL FREE REBAR TIE

(71) Applicants: Clyde Stephan Munsell, Chula Vista, CA (US); James Dalgleish Reid, San Diego, CA (US)

(72) Inventors: Clyde Stephan Munsell, Chula Vista, CA (US); James Dalgleish Reid, San Diego, CA (US)

(73) Assignee: A NEW TWIST LLC, Chula Vista, CA (US)

( * ) Notice: Subject to any disclaimer, the term of this patent is extended or adjusted under 35 U.S.C. 154(b) by 0 days.

(21) Appl. No.: 14/681,897

(22) Filed: Apr. 8, 2015

(65) Prior Publication Data

US 2017/0211276 A1 Jul. 27, 2017

(51) Int. Cl.
*E04C 5/16* (2006.01)

(52) U.S. Cl.
CPC ..... *E04C 5/166* (2013.01); *E04C 5/163* (2013.01)

(58) Field of Classification Search
CPC ..... E04C 5/166; E04C 5/163; E04B 1/58
USPC ..... 52/698, 712, 855, 856, 857
See application file for complete search history.

(56) References Cited

U.S. PATENT DOCUMENTS 735,228 A * 8/1903 Ellinger ..... E04C 5/167 52/719
919,099 A * 4/1909 Wedmore ..... E04C 5/167 52/685
1,046,913 A * 12/1912 Weakley ..... E04C 3/08 52/633
1,149,648 A * 8/1915 Henderson ..... E04C 5/167 52/719
1,158,957 A * 11/1915 Bates ..... B65D 63/12 24/27
1,185,764 A * 6/1916 Brooks ..... E04C 5/168 52/685
1,692,166 A * 11/1928 Orville ..... E04G 17/0754 249/215
1,838,124 A * 12/1931 White ..... E04C 5/166 52/719
3,728,836 A * 4/1973 Gates ..... E04G 17/0754 249/215
4,096,680 A * 6/1978 Ritter ..... E04C 5/166 52/665

(Continued)

OTHER PUBLICATIONS

Supire Steel Wire Company, Product page <http://sswire515.sell.everychina.com/p-102833288-loop-tie-wire-used-for-binding-bags-cardboard-rebar.htnnl> (Year: 2018).*

*Primary Examiner* — Brent W Herring
(74) *Attorney, Agent, or Firm* — S&L US IP Attorneys, P.C.; Timothy Marc Shropshire; Eric Brandon Lovell

(57) ABSTRACT

Tool Free Rebar Tie—A metal wire tie consisting of a piece of 16 gauge wire between 8 and 12 inches long with a loop on each end and each loop closed with a twist. The inventive device is used to fasten rebar on construction sites prior to a concrete pour. The user grips the wire, placing gloved fingers through the loops, and wraps the wire around the joint where two rebar sections come together. The tie is used in place of a mechanical system and requires no tools or other devices to fasten the metal rods which reinforce concrete. Application of the tie is 2-3 times faster than the method currently in use providing substantial savings in man power and time for virtually any construction job where reinforced concrete is required.

7 Claims, 2 Drawing Sheets

(56) References Cited

U.S. PATENT DOCUMENTS 4,375,118 A * 3/1983 Saylor ..... B65D 63/10 24/27
5,054,614 A * 10/1991 Glaus ..... E04G 21/122 206/343
5,275,383 A * 1/1994 Wick ..... E04H 17/268 256/47
5,699,642 A * 12/1997 McDevitt, Jr. ..... E04C 5/162 24/16 PB
5,913,341 A * 6/1999 Jones ..... E04C 5/166 140/119
6,354,054 B1 * 3/2002 Verelli ..... E04C 5/168 248/440
6,503,434 B1 * 1/2003 Mayer ..... E04C 5/166 264/273
6,655,105 B2 * 12/2003 Swenson ..... E04C 5/163 403/391
7,174,685 B2 * 2/2007 Hayes ..... E04C 5/12 52/223.6
8,112,964 B2 * 2/2012 Baruh ..... E04C 5/167 52/685
8,984,837 B2 * 3/2015 Curtis ..... E04B 1/4185 52/379
2003/0024204 A1 * 2/2003 Swenson ..... E04C 5/163 52/677
2004/0148880 A1 * 8/2004 Hayes ..... E04C 5/12 52/223.1
2009/0188200 A1 * 7/2009 Kelly ..... E04G 21/122 52/719
2010/0000173 A1 * 1/2010 Thompson ..... B28B 23/0025 52/689
2014/0311071 A1 * 10/2014 Curtis ..... E04B 1/4185 52/309.1
2015/0211232 A1 * 7/2015 Baruh ..... E04C 5/167 52/719

* cited by examiner

TOOL FREE REBAR TIE

BACKGROUND OF THE INVENTION

1. Field of the Invention

The present invention relates generally to pouring of reinforced concrete and more specifically to the method of securing rebar sections where they come together while constructing a grid of rebar to reinforce the concrete once it has been poured. When an application of concrete for construction requires more strength and stability than the concrete itself can provide, the concrete is reinforced by laying rods of metal in a grid pattern in the void prior to pouring the concrete. Anyplace where the rods, called rebar, overlap a metal wire is wrapped around the joint so the rods do not move during the pour. The basic method of applying this wrap to secure the joint has changed little over the past few decades. A piece of wire with a small loop at each end is placed around the joint and then a tool is used to wrap the wire around the joint by placing the loops onto pegs on the tool and twisting the wire around the joint. This process is cumbersome as the process of connecting the small loops at the ends of the wire onto the tool is intricate and time consuming, especially when the worker is wearing gloves to protect his hands on the job site. The inventive device removes the necessity for a tool to be used at all in the process as the tie has a large loop on each end through which a worker can place his gloved fingers and wrap the wire around the rebar joint without any mechanical assistance. Application of the tie is 2-3 times faster than the method currently in use providing substantial savings in man power and time for virtually any construction job where reinforced concrete is required.

2. Description of the Prior Art

A complete search of the patent database reveals no patent for devices for this specific task, including the tool currently in use. There appears to be no previous attempts to patent any device for this application.

SUMMARY OF THE INVENTION

In view of the foregoing inefficiency inherent in the present device present in the industry, the present invention provides a method for increased efficiency, time and labor savings on any construction site where reinforced concrete is required.

The general purpose of the present invention, which will be described subsequently in greater detail is to provide an improved method of securing rebar in a grid prior to a concrete pour that has the advantages of the current systems mentioned heretofore and novel features that result in more efficient application of wire ties to secure the rebar reinforcements which is not anticipated, rendered obvious, suggested, or even implied by any of the prior art systems, either alone or in any combination thereof.

To attain this, the present invention generally adds large loops at either end of section of wire 8 to 12 inches long allowing the user to attach the wire to the rebar faster and without the use of mechanical devices.

There has thus been outlined, rather broadly, the more important features of the invention in order that the detailed description thereof may be better understood, and in order that the present contribution to the art may be better appreciated.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an improvement in efficiency joining rebar to form a grid in reinforced concrete construction projects that will overcome the shortcomings of the prior devices.

Other objects and advantages of the present invention will become obvious to the reader and it is intended that these objects and advantages are within the scope of the present invention.

To the accomplishment of the above and related objects, this invention may be embodied in the form illustrated in the accompanying drawing, attention being called to the fact, however, that the drawings are illustrative only, and that changes may he made in the specific construction illustrated and described within the scope of any appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
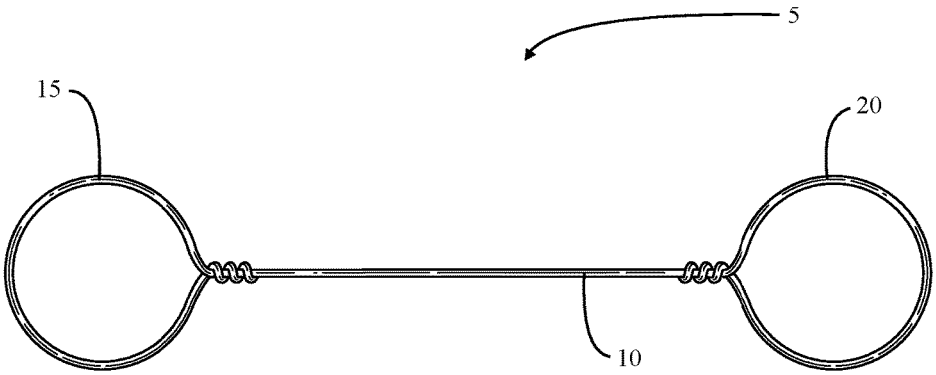
FIG. 1 is a top plan view of the rebar tie.
Figure 2:
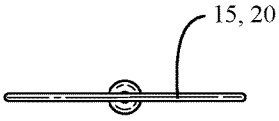
FIG. 2 is a front elevational view of the rebar tie.
Figure 3:
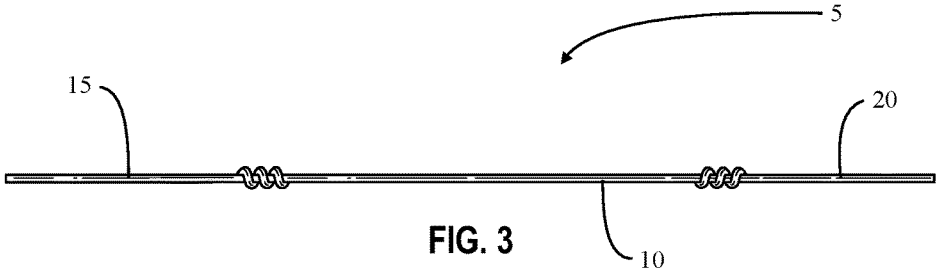
FIG. 3 is a side elevational view of the rebar tie.
Figure 4:
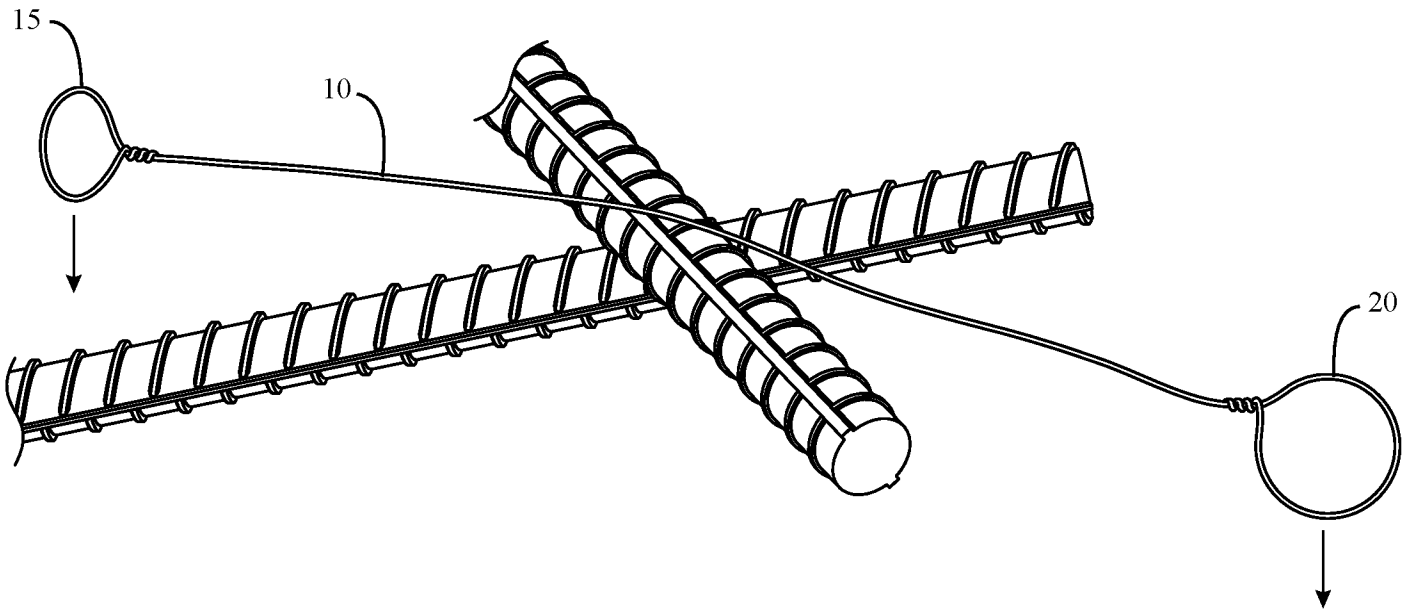
FIG. 4 is a perspective view of the rebar tie with two intersecting pieces of rebar.

Turning now descriptively to the figures, FIGS. 1-4 illustrate a tie 5 to join rebar sections in reinforced concrete projects, said tie 5 consisting of a single section 10 of 16 gauge wire with a 2-inch diameter loop 15, 20 at each end. The wire section 10 between the loops 15, 20 is between 8 and 12 inches long to allow for different size rebar which may be found on construction sites. The wire is made of soft steel and is either epoxy coated or galvanized.

The user wraps the wire around the joint (any place where two pieces of rebar intersect, either parallel or perpendicular) and using the loops 15, 20 as finger holds for leverage, twists the wire to secure the wire around joint to ensure integrity of the grid and that the rebar does not move when the concrete is poured.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A system for tying rebar comprising:

a. two or more intersecting pieces of rebar; and b. a rebar tie comprising:

i. a first loop;

ii. a second loop; and iii. a middle section that separates the first loop from the second loop, wherein the first loop, the second loop, and the middle section are collectively constructed from a single, continuous piece of metal wire having a first end and a second end, wherein the first end and the second end are twisted around the middle section a plurality of times, securing the first end and the second end to the middle section to form the first loop and the second loop, respectively, wherein the first loop and the second loop each have a diameter of two inches, wherein the tie is configured to be tied entirely by hand, wherein the first loop and the second loop are each configured to receive a user's finger therethrough to effectuate a process of securing the tie around the rebar intersection, such that the user may wrap the middle section around the rebar intersection using the first loop and the second loop as finger holds for leverage.

2. The system of claim 1, wherein the first end and the second end are twisted around the middle section at least three times.

3. The system of claim 1, wherein a length of the middle section is between eight and twelve inches.

4. The system of claim 1, wherein the wire is coated with an epoxy.

5. The system of claim 1, wherein the wire is galvanized.

6. A system for tying rebar comprising:

a. two or more intersecting pieces of rebar; and b. a rebar tie comprising:

i. a first loop;

ii. a second loop; and iii. a middle section that separates the first loop from the second loop, wherein a length of the middle section is between eight and twelve inches, wherein the first loop, the second loop, and the middle section are collectively constructed from a single, continuous piece of metal wire having a first end and a second end, wherein the first end and the second end are twisted around the middle section at least three times, securing the first end and the second end to the middle section to form the first loop and the second loop, respectively, wherein the first loop and the second loop each have a diameter of two inches, and wherein an exterior surface of the wire is coated, wherein the tie is configured to be tied entirely by hand, wherein the first loop and the second loop are each configured to receive a user's finger therethrough to effectuate a process of securing the tie around the rebar intersection, such that the user may wrap the middle section around the rebar intersection using the first loop and the second loop as finger holds for leverage.

7. The system of claim 6, wherein the coating on the exterior surface of the wire is selected from the group consisting of zinc and epoxy.

* * * * *